United States Patent [19]

Vallejos

[11] 4,098,238

[45] Jul. 4, 1978

[54] ROTARY VALVE SYSTEM FOR MOTORS AND THE LIKE HAVING IMPROVED SEALING MEANS

[75] Inventor: Tony E. Vallejos, Paramount, Calif.

[73] Assignee: Alto Automotive, Inc., Deerfield, Ill.

[21] Appl. No.: 653,195

[22] Filed: Jan. 28, 1976

[51] Int. Cl.[2] ..... F01L 7/00

[52] U.S. Cl. ..... 123/81 B; 123/79 R; 123/188 B; 123/190 BD; 123/190 E

[58] Field of Search ..... 123/81 R, 81 B, 79 R, 123/79 A, 90.24, 90.26, 188 B, 190 R, 190 B, 190 BB, 190 BD, 190 E; 251/301; 137/613, 614.11

[56] References Cited

U.S. PATENT DOCUMENTS

| | | | |
|---|---|---|---|
| 1,120,181 | 12/1914 | Clement | 123/190 E |
| 1,273,002 | 7/1918 | Samuels | 123/188 B |
| 1,311,200 | 7/1919 | Abell | 123/79 R |
| 1,476,359 | 12/1923 | Ford | 123/188 B |
| 1,493,080 | 5/1924 | Kloman | 123/190 BB |
| 1,599,430 | 9/1926 | Ofeldt | 123/190 D |
| 1,671,254 | 5/1928 | Porter | 123/190 E |
| 1,777,464 | 10/1930 | Edwards | 123/190 BD |
| 1,902,130 | 3/1933 | Keister | 123/79 R |
| 1,924,188 | 8/1933 | Hall | 123/190 BB |
| 1,951,759 | 3/1934 | Keister | 123/79 R |
| 3,990,423 | 11/1976 | Cross | 123/190 BD |

FOREIGN PATENT DOCUMENTS

| | | | |
|---|---|---|---|
| 1,059,396 | 3/1954 | France | 251/301 |

*Primary Examiner*—Charles J. Myhre
*Assistant Examiner*—David D. Reynolds
*Attorney, Agent, or Firm*—Garrettson Ellis

[57] ABSTRACT

A rotary valve system for a motor and the like includes a flow conduit and rotary valve means interposed in the flow conduit. Intermittent sealing means are provided for preventing flow through the flow conduit, comprising a sealing surface intermittently positionable in stationary, sealing relationship across the conduit. Means are also provided for moving the sealing surface into such stationary sealing relationship with the flow conduit, and out of sealing relationship with the flow conduit in a manner correlating with the operation of the rotary valve means, to facilitate sealing as the valve operates.

38 Claims, 10 Drawing Figures

FIG. 5
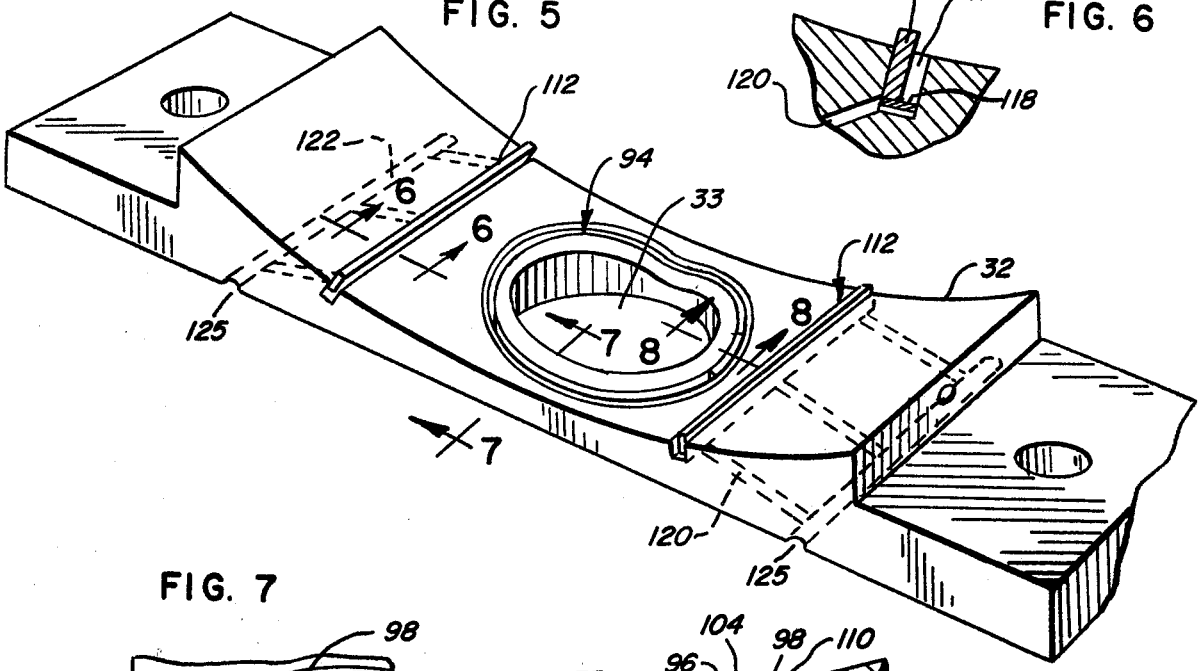
FIG. 6
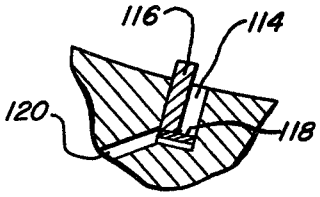
FIG. 7
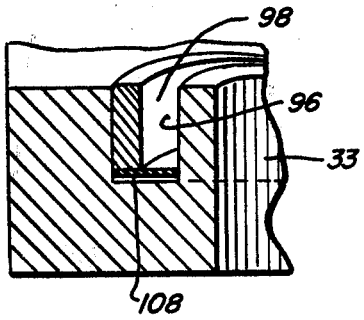
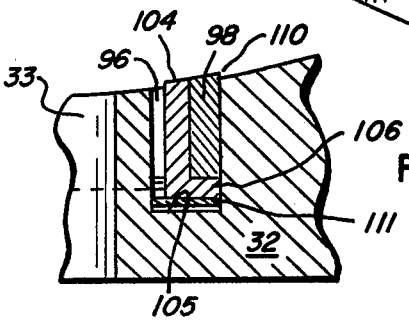
FIG. 8
FIG. 9
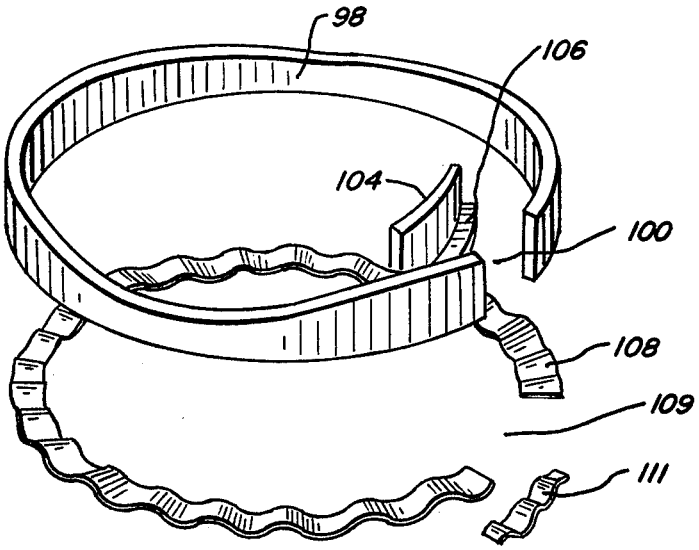

ROTARY VALVE SYSTEM FOR MOTORS AND THE LIKE HAVING IMPROVED SEALING MEANS

BACKGROUND OF THE INVENTION

In the search for improvements in the operation of internal combustion engines, many attempts have been made to replace the conventional poppet valves of an engine cylinder with rotary valves. One such attempt is illustrated in U.S. Pat. No. 1,692,396. Another, more recent, engine design utilizing rotary valves is shown in an article by David Scott, relating to a cruciform engine, beginning on page 78 of the July, 1975 issue of *Popular Science.*

These, however, are merely exemplary of hundreds of patents and articles relating to the use of rotary valves in engines.

Rotary valves have been considered to have significant advantages over the conventional poppet valves for an engine cylinder because they can operate more rapidly, reducing the problem which can be found in high speed poppet valve engines, in which the poppet valve actually can tend to run behind the remainder of the engine, the valve return springs being inadequate to cause them to keep up with the operation of the engine at an extremely high RPM rate.

Also, the maximum compression of an engine must be limited so that the piston at top dead center position does not strike the open poppet valve. If one desires to increase the compression beyond such a level, it would be desirable to use rotary valves.

Furthermore, in many designs of rotary valves, a single port, functioning as both fuel inlet and exhaust gas outlet, can be provided to the combustion cylinder. This reduces the extremely high temperatures of the exhaust valve in a conventional poppet valve engine, reducing the possibility of preignition upon compression of the fuel mixture prior to firing.

Rotary valves also require less energy to operate than poppet valves, increasing the energy output of the engine.

However, despite the various significant potential advantages that a rotary valve system can be expected to have in an internal combustion engine, they have not come into commercial use, largely because rotary valves tend to leak if they are loose enough to permit free rotation, but they may seize if they are tight enough to contain the combustive pressures generated in the combustion chamber. To date, there appears to have been proposed no effective way to seal rotary valves in such a manner that the leakage of fuel vapors and exhaust gas is prevented to such a degree over the long term that the commercialization of a motor using a rotary valve system would be feasible.

In accordance with this invention, a rotary valve system having an auxiliary sealing mechanism is provided, particularly for sealing of the combustion chamber during compression and ignition states of motor operation.

As a result, the rotary valve itself no longer has to perform a significant sealing role against the pressures of the combustion chamber, but may simply work as a metering device for fuel and exhaust gas at relatively ambient pressures. Thus, the problem of rotary valve seizing can be eliminated, since the critical sealing functions are provided by other means.

Thus, the many advantages of the rotary valve may be utilized in motors designed in accordance with this invention.

DESCRIPTION OF THE INVENTION

In this invention, a rotary valve system for a motor and the like is provided, including a flow conduit for fuel and exhaust, and rotary valve means interposed in the flow conduit.

In accordance with this invention, intermittent sealing means are provided for preventing flow through the flow conduit. These intermittent sealing means comprise a sealing surface intermittently positionable in stationary, sealing relationship across the conduit. Also, means are provided for moving the sealing surface into the aforesaid stationary, sealing relationship with the flow conduit, and out of such sealing relationship with the flow conduit, in a manner correlating with the operation of the rotary valve means, to provide intermittent sealing at appropriate moments as the valve operates.

Accordingly, when the rotary valve utilized in this present invention occupies a position to block the flow of material to or from the combustion chamber, the intermittent sealing means can be adapted to occupy its stationary, sealing relationship across the flow conduit, typically at the entrance to the combustion chamber, to seal the chamber. When the rotary valve means is in open position, to either inject fuel vapors into the combustion chamber or to permit the withdrawal of exhaust gas, the intermittent sealing means is adapted to be out of sealing relationship with the conduit, to permit communication through the rotary valve into or out of the combustion chamber. Thus, as the valve rotates to alternatingly open and close the fuel inlet and exhaust gas outlet, the intermittent sealing means can also be moved back and forth into corresponding open and sealing positions as the function of the motor dictates.

One particular advantage of this present invention lies in the fact that the intermittent sealing means provides a stationary seal of the combustion chamber, while the rotary valve may at the same time continue in constant rotary motion during the operation of the engine. A stationary seal between unmoving surfaces results in much less wear of the sealing parts, when compared with a seal involving relatively moving surfaces. Also, a stationary seal can provide more effective high pressure sealing. This results in greater sealing reliability and life of the sealing parts.

Typically, several rotary valve systems as described above may be positioned in linear array, and operated by a common control shaft means, which may particularly be a camshaft as described below. Also, the several rotary valves in this linear array of rotary valve systems may all be defined by a single, rotatable shaft member, for simplicity of construction of motors in accordance with this invention, and for permanently determining the proper operating sequence of the various valve systems.

If desired, this invention can be used in conjunction with motors having separate inlet and outlet valves, as well as in other high pressure fluid handling apparatus besides motors.

Figure 2:
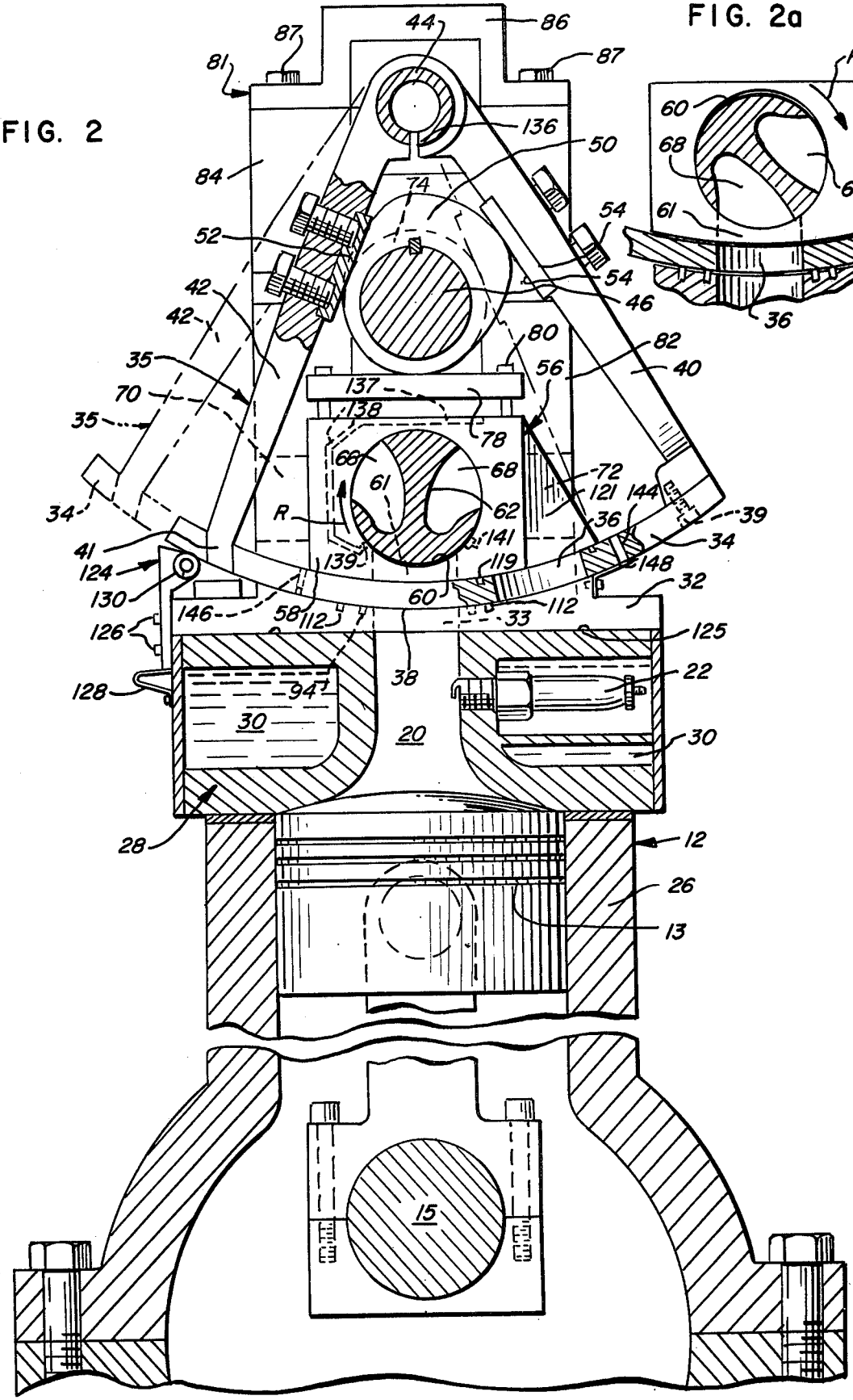
FIG. 2 is a vertical sectional view taken through a valve assembly of FIG. 1, but also including additional structure in its lower portion not illustrated in FIG. 1.
Figure 2A:
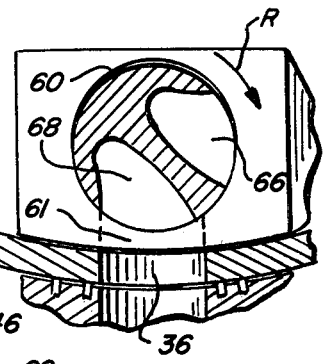

FIG. 2*a* is a detailed sectional view of portions of the structure as shown in FIG. 2, but in a different operational position.

Figure 1:
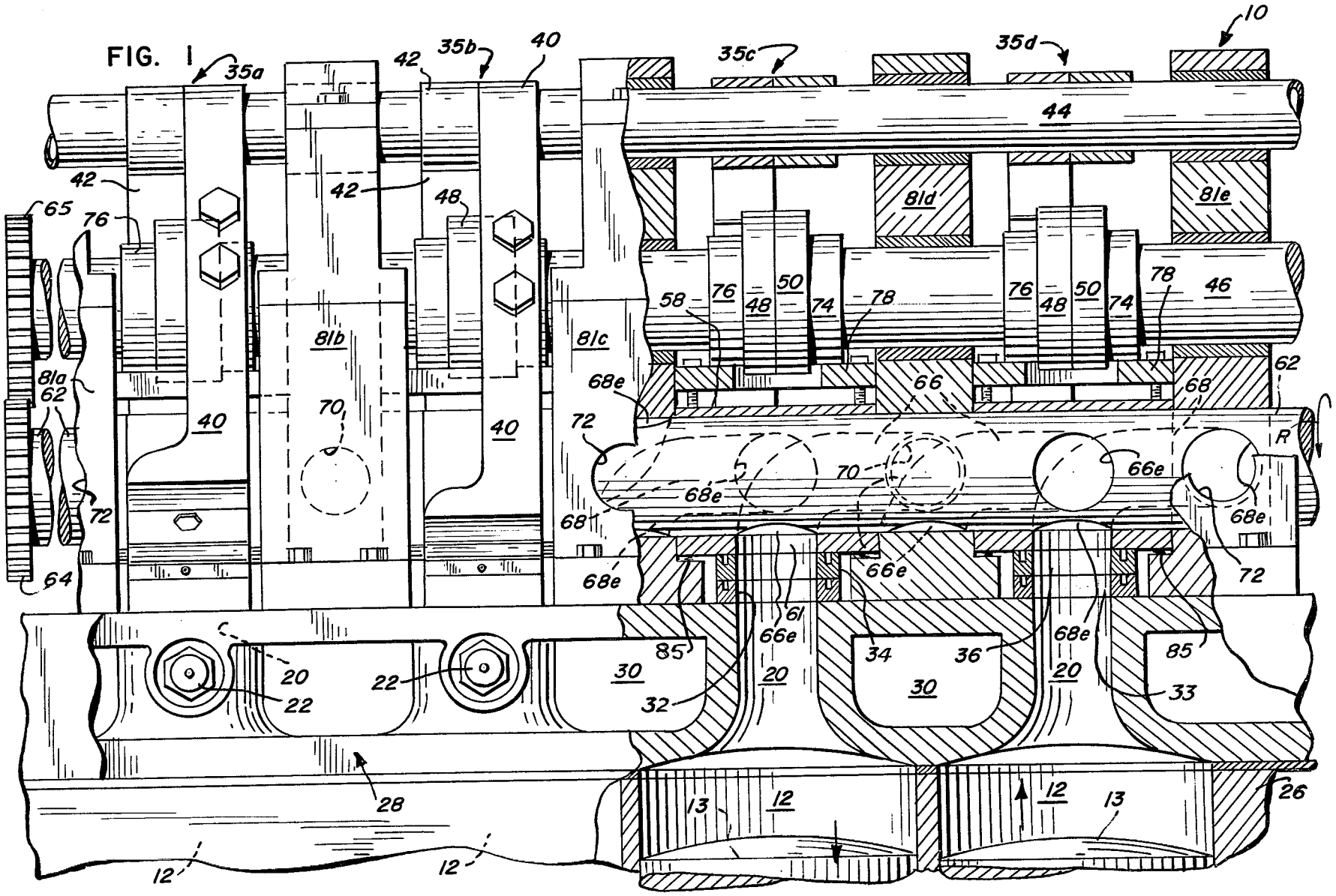
FIG. 1 is an elevational view, with some parts broken away, of a motor made in accordance with this invention, showing in particular pistons and cylinders, and portions of the valving and sealing system of this invention.
Figure 3:
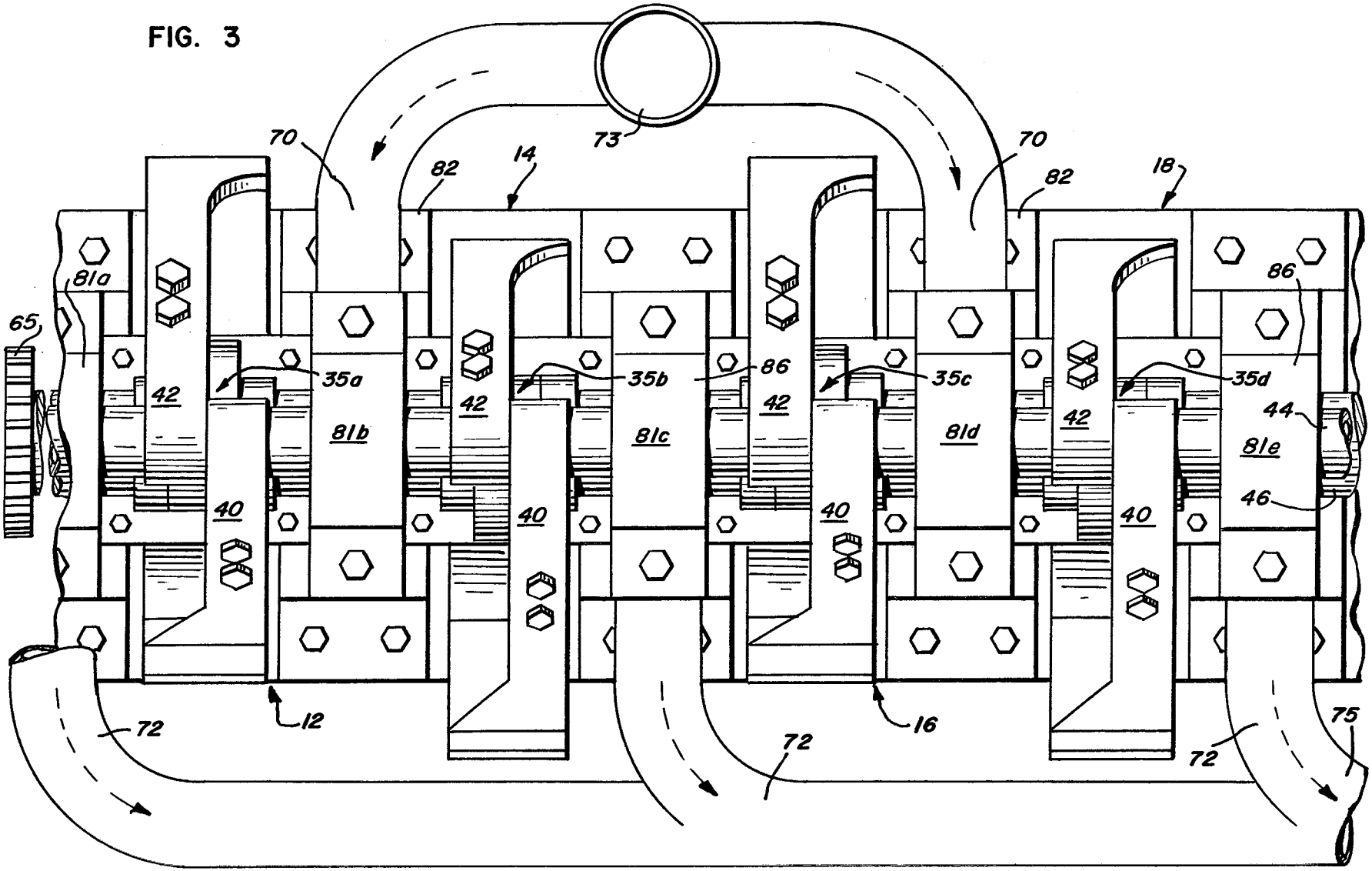

FIG. 3 is a top plan view of the motor of FIGS. 1 and 2.

Figure 4:
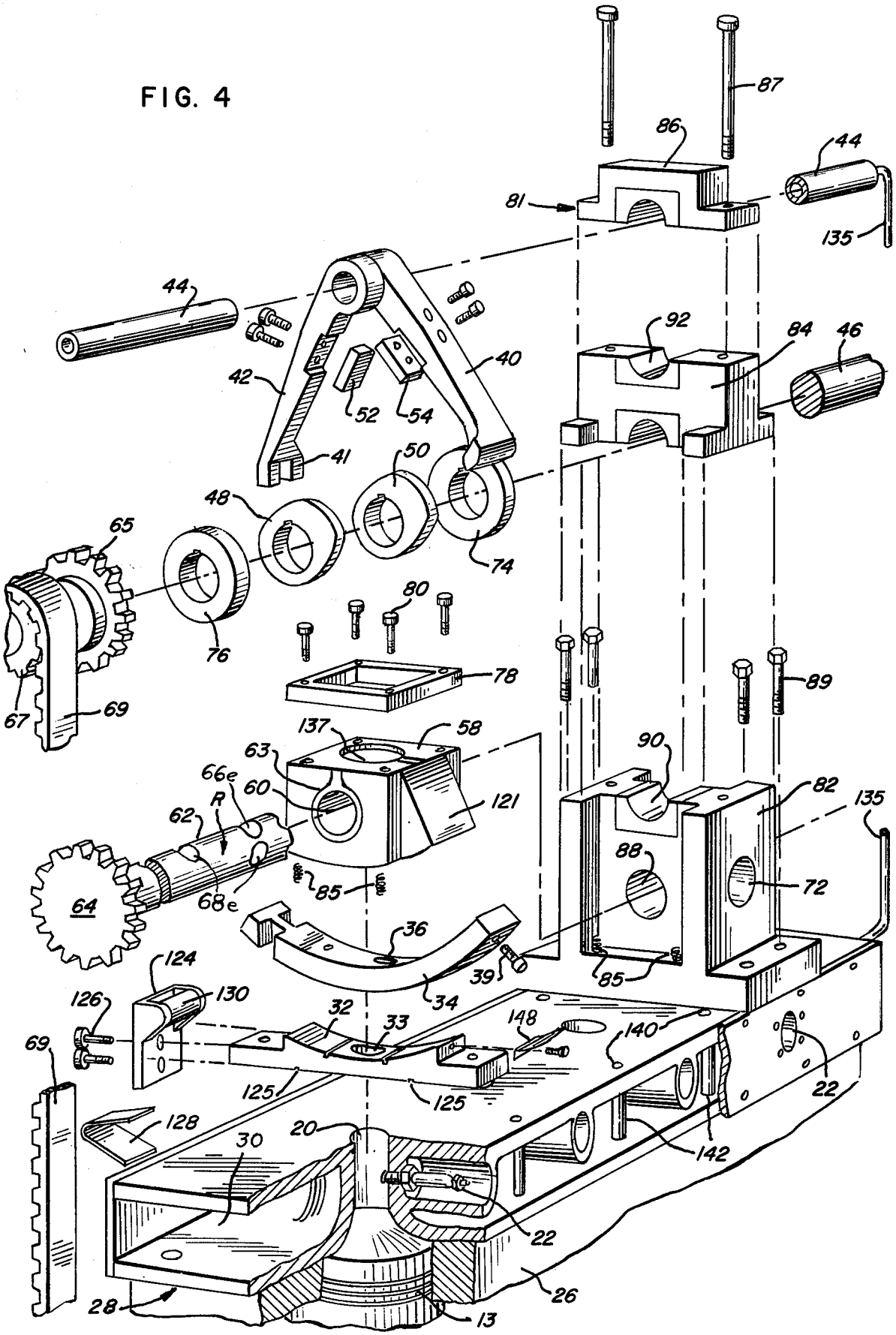

FIG. 4 is an exploded perspective view of one valving and sealing system for a single piston and cylinder of the motor of FIGS. 1 through 3, and also showing related structural parts.

FIG. 5 is a perspective view of a valve plate bed utilized in the preceeding figures.

FIG. 6 is a sectional view taken along line 6—6 of FIG. 5.

FIG. 7 is a sectional view taken along line 7—7 of FIG. 5.

FIG. 8 is a sectional view taken along line 8—8 of FIG. 5.

FIG. 9 is a perspective, exploded view of certain parts otherwise illustrated in FIGS. 5, 7, and 8.

Referring to the drawings, a portion of a motor 10 is illustrated. Motor 10 may be of entirely conventional design, except as otherwise indicated. The particular embodiment shown comprises an iternal combustion engine having four reciprocating piston and cylinder assemblies or combustion chambers 12, which may be of conventional construction. The piston and cylinder assemblies include a reciprocating piston 13 which may be connected to a crankshaft 15 in a usual manner. However, while the invention of this application can be used with conventional piston, cylinder, and crankshaft assemblies, it is specifically contemplated that the invention of this application can be used in conjunction with a piston, cylinder, and crankshaft arrangement similar to that illustrated in U.S. patent application Ser. No. 578,805, filed May 19, 1975, now U.S. Pat. No. 3,985,114 by myself, in order to achieve the advantages of this present invention in conjunction with the advantages of the invention described in that application.

The invention of this application can be used with diesel, two-cycle, four-cycle engines, and the like, but the drawings illustrate, for exemplary purposes, a four-cycle engine.

Each piston and cylinder assembly includes a neck portion 20 of the cylinder, having an open top, with a spark plug 22 being transversely mounted in each neck portion 20.

This particular shape of combustion chamber can provide the advantages of a stratified charge arrangement, since fuel vapor will tend to be concentrated in the upper portion of neck portion 20 of the combustion chamber. This permits operation of the engine with a very lean fuel mixture. Also, it is believed that this particular shape can tend to suppress knock or preignition.

Piston and cylinder assemblies 12 can be defined by retainer 26, neck portions 20 being defined by a block 28, which may contain flow channels 30 defined through it. Channels 30 permit the flow of liquid coolant, to reduce the peak combustion temperatures of the combustion chamber, and accordingly to reduce the possibility of knocking as well as to reduce the generation of nitrogen oxide pollutants.

To define each valve assembly 35, bed 32, having aperture 33, is affixed to the top of block 28 in a position to permit moveable valve plate 34 to be in sliding contact with bed 32. Valve plate 34 and bed 32 define curved, matching, facing surfaces to permit valve plate 34 to slidingly reciprocate back and forth on bed 32 with rocking motion, as shown in FIG. 2.

Valve plate 34 defines an aperture 36, which is positioned to be in registry with aperture 33 and neck portion 20 in a first rocking position of valve plate 34 (as in FIG. 2*a*), and to be out of registry with aperture 33 and neck portion 20 in a second rocking position, as shown in FIG. 2, so that an unbroken sealing surface 38 is positioned across the open top of neck portion 20. This latter position permits obstruction of fluid communication into or out of the combustion chamber, and acts to seal it during the compression and combustion phases of the engine.

Valve plate 34 is attached at one end to rocker arm 40 by bolts 39 or the like, and is slidingly retained at its other end by prongs 41 of the rocker arm 42, in a manner to permit a slight amount of bending axial motion of valve plate 34, relative to arm 42.

Rocker arms 40, 42 are pivotally attached to pivot shaft 44, serving as fulcrum for their rocking motion. Camshaft 46 is positioned between arms 40, 42, and carries cams 48, 50 (see FIG. 4) which bear respectively against bearing members 52, 54, which are carried respectively by arms 42, 40. Accordingly, as camshaft 46 rotates, cams 48, 50 are positioned to cause arms 40, 42, and valve plate 34, to reciprocate back and forth with rocking motion, with a positive desmodromic action which is preferably governed solely by the rotational position of the camshaft, and not by springs or the like. Hence, the abovementioned first rocking position, where aperture 36 is aligned with neck portion 20, is brought about by one rotational position of camshaft 46, and the second rocking position by another camshaft rotational position.

Each rotary valve assembly 56 comprises a valve block 58, one for each piston and cylinder assembly 12, each defining an aperture 60, through which rotary valve member 62 passes, plus a bottom aperture 61 for communication with aperture 36 in the first rocking position.

In this particular embodiment, rotary valve rod member 62 is defined by a single rod, terminating with a gear 64, passing through all of the valve blocks 58. Gear 64 meshes with terminal gear 65, mounted on camshaft 46, so that the rotation of valve rod member 62 is also controlled by and synchronized with the rotation of camshaft 46. Cog pulley 67 is also attached to camshaft 46 for rotation thereof, and is driven by cog belt 69, which in turn is driven by rotating crankshaft 15.

Valve rod member 62 defines, as shown in FIG. 1, a series of inlet ports 66 for passing fuel vapors to the piston and cylinder assemblies 12, and a series of exhaust ports 68, for carrying exhaust gas away from the cylinders in the exhaust stroke of the piston. An inlet port 66 and an exhaust port 68 are each provided for each valve block 58 and are positioned to communicate through bottom aperture 61, in the first rocking position, with neck portion 20 of the combustion chamber, when valve rod member 62 is in a predetermined rotational position.

Each inlet port 66 and exhaust port 68 leads longitudinally along valve rod member 62, being enclosed within the valve rod member, breaking at both ends through the sides of the valve rod member. Ends 66*e* of the inlet ports and ends 68*e* of the outlet ports are shown in FIG. 1. Ends 66*e*, 68*e* of each inlet and exhaust port occupy longitudinally displaced positions along valve rod 62, which positions are also circumferentially spaced as well as longitudinally spaced on valve rod 62. One of the ends of ports 66, 68 communicate with aperture 61 in various, predetermined rotational positions of valve rod 62.

The degree of circumferential spacing of the respective ends of ports 66, 68 can be defined by an angle of about 90°, as shown in FIG. 1, but other circumferential spacings can be used as desired.

The other set of ends of ports 66, 68, which are longitudinally spaced from apertures 61, communicate respectively with fuel inlet ports 70 and exhaust manifold ports 72, when valve rod member 62 occupies a rotational position permitting communication of the other end of the respective port through bottom aperture 61 into neck portion 20. Inlet ports 66 communicate in this circumstance with their associated inlet manifold ports 70. Exhaust ports 68 communicate with their associated exhaust manifold ports 72. While this takes place, valve plate 34 will occupy its first rocking position.

As valve member 62 rotates in registry with the rotating camshaft 46, cams 48 and 50 are adjusted to cause each set of rocker arms 40 and 42 to place aperture 36 of valve plate 34 into the first rocking position, that is: registry with neck portion 20 of the combustion chamber 12, at the same time that each inlet port 66 assumes a rotational position to permit communication between each combustion chamber 12, through the inlet port 66, to the inlet manifold port 70. Aperture 36 remains in registry with neck portion 20 while valve member 62 rotates into another rotational position to permit communication from the combustion chamber through exhaust port 68 to exhaust manifold port 72. This situation occurs during the intake and exhaust cycles of operation.

In another part of the cycle of operation of the engine, camshaft 46 causes arms 40, 42 to move aperture 36 away from neck portion 20 to the second rocking position, specifically during the compression and combustion cycles of operation. Correspondingly, the inlet and exhaust ports 66, 68 are generally not in a position of registry with bottom aperture 61 at this time of the operation.

Also, during the compression and combustion phases of the cycle of operation of the motor of this invention, additional cams 74, 76, mounted on camshaft 46, press against an adjustable-height frame 78, attached to valve block 58. The action of cams 74, 76 depresses valve block 58 against valve plate 34, in its second rocking position, to provide reinforcing sealing pressure of valve plate 34 against bed 32 during the compression and combustion phases of the motor operation.

Cams 48, 50 are proportioned to prevent rocking movement of arms 40, 42 during this phase. After the combustion stroke is complete, further rotation of camshaft 46 causes cams 74, 76 to release the pressure on frame 78, allowing block 58 to rise as in FIG. 2*a*, impelled by springs 85, mounted on pillow blocks 81 as shown in FIG. 4.

The amount of motion imparted by cams 74, 76 to block 58, to move the block into engagement with the valve plate 34, may preferably be a total distance of only about 0.01 to 0.03 inch, for example about 0.015 inch, for minimal expenditure of energy.

Aperture 60 in block 58 is made slightly oval, as shown in FIGS. 2 and 2*a*, to accomodate the up and down motion of block 58 without requiring corresponding up and down motion of valve member 62.

The ends of each aperture 60 may be conventionally sealed with shaft seals 63 or the like, positioned about valve rod 62, to block any low pressure leakage from the ends of aperture 60.

Adjustable-height separate plate member or frame 78 is carried by bolts or set screws 80, which are set in valve block 58. The purpose of frame 78 is to permit vertical adjustment of the position of valve block 58 against valve plate 34 to the desired amount, and to provide a means for adjustment to suit the individual requirements of the engine, as well as to permit adjustment as the engine wears.

Each valve assembly 35 of valve block 58, arms 40, 42, and the like is separated from its adjacent assembly by a pillow block assembly 81, comprising a set of pillow block members 82, 84, 86. Block members 82, 84, 86 define apertures 88, 90, 92 to receive, respectively, valve rod member 62, camshaft 46, and pivotal shaft 44. Also, the pillow block members 82 (as illustrated in FIG. 3) each define an inlet manifold port 70 or an exhaust manifold port 72, for communication with a section of valve rod member 62, within the pillow block member, which defines one end of an inlet port 66 or an exhaust port 68.

It will be noted in FIG. 3 that various arms of both inlet manifold port 70 and exhaust manifold port 72 serve two piston and cylinder assemblies 12 and their associated valve assemblies 35. This is accomplished by having the associated inlet ports 66 of two adjacent valve assemblies 35 lead to the same inlet manifold port 70. Correspondingly, the exhaust ports 68 of two adjacent valve assemblies 35 lead to the same exhaust manifold port 72.

Specifically, exhaust port 68 of valve assembly 35*a* leads to the exhaust manifold port 72 of pillow block 81*a*, while the corresponding inlet port 66 leads to an inlet manifold port 70 in pillow block 81*b*. The exhaust port 68 for valve assembly 35*b* leads to exhaust manifold port 72 in pillow block 81*c*, while its inlet port 66 leads to the inlet manifold port 70 in pillow block 81*b*. The exhaust port 68 of valve assembly 35*c* leads to exhaust manifold port 72 in pillow block 81*c*, while its inlet port 66 leads to inlet manifold port 70 of pillow block 81*d*. The exhaust port 68 of valve assembly 35*d* leads to exhaust manifold port 72 in pillow block 81*e*, while its inlet port leads to inlet manifold port 70 in pillow block 81*d*.

Other arrangements of exhaust and inlet manifold systems can, of course, also be utilized as desired by the user. However, one will note that the inlet manifold system shown is desirably symmetrical in shape, and thus provides an essentially equal flow of fuel vapors to each system and cylinder assembly 12.

Fuel inlet 73 leads to inlet manifold ports 70 from the carburetor, while exhaust outlet 75 leads to the muffler, if any, and then to the exterior.

The construction of pillow blocks 81*a* through *e* is illustrated by pillow block 81 in FIG. 4, being shown to be held together and attached to block 28 by bolts 87, 89.

An auxiliary sealing system 94 is typically provided in valve plate bed 32, as shown in FIGS. 5 through 9.

An annular groove 96 is positioned about aperture 33 in valve plate bed 32. Split ring 98 is positioned within groove 96, defining a split space 100. Insert 104 fits across space 100 to seal it. Skirt 106 of insert 104 fits under ring 98 in a deepened portion 105 of groove 96, as shown in FIG. 8, which is proportioned to receive skirt 106.

Space 100 permits a small variance of the dimensions of split ring 98, as it moves to a slight degree, and expands and contracts due to temperature changes and dynamic conditions.

Split ring 98 rests upon a corrugated wave ring 108 that serves as a spring member, and defines split 109 of similar dimension to space 100. Corrugated wave strip 111 fits in deepened portion 105 of groove 96, under skirt 106. Accordingly, as valve plate member 34 is pressed down upon bed 32, a focused pressure seal will be created against the underside of valve plate member 34 by split ring 98 and insert 104, while those members will be pushed downwardly into recess 96, against the resisting spring bias action of wave ring 108 and strip 111.

The usual maximum amount of depression or the clearance 110 of members 104, 98 may be on the order of 0.015 inch, similar to the amount of depression of valve block 58 by cams 74, 76. Upon engagement with the valve plate member in stationary sealing relationship in the second rocking position, members 104, 98 will preferably be pushed downwardly to be flush with the surface of valve bed 32, to facilitate the momentary, stationary sealing action during each compression and combustion cycle of the engine.

When valve plate 34 is moving in the intermittent rocking motion described previously, split ring 104 and insert 98 are preferably proportioned to scrape against the underside of plate member 34, to wipe away oil and prevent it from passing into aperture 33.

Similarly, wiper members 112 comprise transverse channels 114, as shown in FIG. 6, containing a floating blade 116, supported by a wave spring member such as corrugated strip 118. Flow channels 120 communicate with transverse channels 122, to allow for the flow of oil wiped by blades 116 transversely through channels 120, 122 to the lower edge of valve plate bed, through exit ports 125. From there, the oil can be collected as desired and recycled to the oil pan in conventional manner, as part of an oil lubrication system which shall be described below.

Wiper assemblies 112 thus exhibit the same biased resilience, with blades 116 typically normally projecting upwardly above the surface of valve bed 32 about 0.015 inch, similarly to split ring 98, to provide further oil sealing action for aperture 33.

For oil sealing of the upper surface of valve plate 34, annular ring 119 is provided about aperture 36, being of construction similar to annular ring sealing system 94 about aperture 33.

Projecting portion 121 of valve block 58 is positioned to overlie in the second rocking position those portions of annular ring 119 which lie beyond the main portion of valve block 58, so that a continuous oil seal is provided about aperture 36.

Resilient spring member 124 is for the purpose of biasing the free end of valve plate 34 upwardly, to lift it off of valve bed 32 as shown in FIG. 2*a* when valve plate 34 is not being biased downwardly through the pressure imparted by valve block 58 and cams 74, 76. This reduces the friction of the rocking motion of valve plate 34 between the first and second rocking positions.

Spring member 124 is slidingly mounted on a pair of pins 126, and is biased upwardly by a spring device 128. Spring member 124 also carries one or more rollers 130 upon which the valve plate member rides.

A specific cycle of operation of piston and cylinder assemblies 12, and their associated valve assemblies 35, is as follows:

As shown in FIG. 2, one piston 13 is illustrated to be in its top dead center position, immediately prior to the ignition phase of the engine cycle. Preferably, the compression ratio of the system is in excess of 10 to 1, for most efficient operation, although lower compression ratios are also effectively useable.

As shown in FIG. 2, valve block 58 is pressing against valve plate 34, impelled by the action of cams 74, 76. In turn, valve plate 34 is pressing against valve bed 32, providing a stationary, high pressure seal against the pressurized fuel vapors in neck portion 20. In particular, a focused pressure seal is created by sealing system 94.

During the operation of the engine, valve rod member 62 and camshaft 46 may be in constant rotary motion. However, cams 48, 50 are proportioned so that, during the compression and ignition phases of the cycle, arms 40, 42 and valve plate 34 are stationary, to provide the desired stationary seal.

Upon actuation of spark plug 22 to create a spark, ignition of the fuel vapors in neck portion 20 takes place, driving piston 13 downwardly, and imparting torque to crankshaft 15 either by conventional means, or means described in detail in my co-pending application cited above. Accordingly, piston 13 advances to the bottom dead center position, at which time the ignition phase of the engine cycle is ended.

Typically, before the end of the ignition phase, (e.g. 70° prior to bottom dead center position) camshaft 46 has rotated sufficiently to cause cams 74, 76 to release their pressure on valve block 58. Accordingly, valve block 58 rises (typically by about 0.015 inch) to release its pressure against valve plate 34, which accordingly also rises approximately a similar distance, assisted by spring member 124.

Typically before bottom dead center position (e.g. 60 degrees before) the further rotation of camshaft 46 causes cam 48 to begin to exert pressure on bearing member 52, driving rocker arms 40 and 42 (which may be separate or connected pieces) to the left as illustrated in FIG. 2, to the first rocking position indicated in dotted lines therein, and more specifically shown in FIG. 2*a*. As described previously, in this position, off center aperture 36 of valve plate 34 enters into registry with aperture 61 and the open top of neck portion 20. Piston 13 begins to be impelled upwardly toward top dead center position again by crankshaft 15.

Also, the associated exhaust port 68 in valve rod member 62 enters into registry with aperture 61, as well as its associated exhaust manifold port 72, so that the upward stroke of piston 13 causes exhaust to be expelled through aperture 36, exhaust port 68, and exhaust manifold port 72.

As the piston 13 reaches top dead center position once again, the continuous rotation of valve rod member 62 within valve block 58 causes inlet port 66 to enter into registry with apertures 61 and 36, with the other end of inlet port 66 coming into registry with the associated inlet manifold port 70. During this period of time, valve plate 34 and rocker arms 40, 42 remain generally stationary, despite the continuing rotation of camshaft 46. This is accomplished by appropriate shaping of cams 48, 50.

Accordingly, new fuel enters neck portion 20 from inlet manifold port 70 through inlet port 66 and apertures 61 and 36, impelled by the suction of piston 13 as it travels once again from top dead center to bottom dead center position in the intake phase of the engine cycle.

Typically after piston 13 reaches bottom dead center position again (e.g. 60 degrees after bottom dead center position) the continuing rotation of camshaft 46 causes cam 50 to begin to exert pressure against bearing member 54, causing rocker arms 40, 42 and valve plate 34 to abruptly shift once again to the second rocking position, in which aperture 36 is no longer in registry with aperture 61 and neck portion 20.

As piston 13 rises again in the compression phase of the motor's cycle of operation, cams 74, 76 once again depress block 58, to once again force valve plate 34 into sealing engagement with bed 22. Rocker arms 40, 42 and valve plate 34, as stated before, remain stationary during the sealing phase. Piston 13 continues to rise to top dead center position, at which point maximum compression of the fuel is achieved. Then, at an appropriate time, spark plug 22 ignites the fuel mixture.

Typically, valve rod member 62 rotates once every complete engine cyle.

The design of this invention reduces the possibility of "hot spots" in the engine, avoiding a preignition site for the fuel prior to the appropriate time of ignition as dictated by spark plug 22. Thus, the motor can operate with lower octane fuel and at a higher compression ratio without encountering as great a danger of preignition as is found in conventional motors.

Each of the valve systems 35*a, b, c,* and *d* operate in the aforesaid manner, but the respective inlet ports 66 and outlet ports 68 are positioned on valve rod member 62 so that the cycles of operation of each respective valve system 35 are displaced in this embodiment by 90° of rotation of the valve rod member 62 from the cycle of operation of the immediately preceeding valve system 35. Valve rod member 62 rotates in direction R.

For each valve block 58, the associated inlet and outlet ports 66, 68 are preferably so arranged that pairs of port ends 66*e,* 68*e* of ports serving the same valve block occupy the same circumferential position on valve rod 62, as shown in FIG. 3. Each pair of ends 66*e,* 68*e* is preferably circumferentially displaced about valve rod 62 by about 90° from the other pair of ends of the same ports.

In one specific mode of operation, when camshaft 46 and valve rod member 62 are in a rotational position so that the valve system 35*a* is just beginning the compression phase; valve system 35*c* is simultaneously beginning the intake phase; valve system 35*d* is simultaneously beginning the exhaust phase; and valve system 35*b* is simultaneously beginning the ignition phase. Inlet ports 66 and exhaust ports 68 of valve rod member 62, as well as cams 48, 50, 74, and 76 may be appropriately positioned to achieve this result, which is as shown in FIG. 1. FIG. 3 shows the engine after 270° of rotation of valve rod member 62 beyond the position of FIG. 1, so that, for example, valve system 35*a* is in the intake phase.

Each valve assembly 35 may be lubricated as follows. Shaft 44 may be hollow, and may be connected to a source of pumped oil such as conduit 135 from the oil pan. Alternatively, conduit 135 may pass through the pillow blocks.

One or more ports 136 are positioned above each set of cams 48, 50, 74, 76 so that oil falls freely on the camshaft, lubricating the bearing surfaces between the cams and bearing members 52, 54, as well as the bearing surfaces of cams 74, 76 against frame 78. From there, the oil spills over block 58 to valve plate 34, to lubricate the surface between block 58 and valve plate 34.

Simultaneously, oil can pass into passage 138 from depression 137 in block 58, to lubricate valve rod member 62 rotating in aperture 60. Scraper blade 139 is provided at the end of passageway 138 where oil is placed on valve rod 62, to prevent oil from passing into aperture 61. Second scraper blade 141 removes excess oil from rotating valve rod 62 to prevent it from passing into aperture 61. The groove in which scraper blade 141 resides may be open to the exterior, so that excess oil spills out from the sides of block 58. Scraper blades 139, 141 may be similar in construction to wiper assemblies 112 described previously.

Oil passes from the top of valve plate 34 through apertures 144, 146 to the underside of valve plate 34. Oil passing through aperture 144 may be collected on strip 148, which may be attached to bed 32 as shown in FIG. 2. Accordingly, as valve plate 34 rocks back and forth on bed 32, oil retained by strip 148, and oil passing through aperture 146, are spread along the junction between plate 34 and bed 32 for lubrication thereof, except where prevented by wiper assemblies 112 and sealing system 94.

Oil collected in channel 114 of wiper assemblies 112 passes out of apertures 125 at the bottom of bed 32, from where the oil can be collected by apertures 140 and conduits 142, through block 28 for recycling to the oil pan.

Accordingly, the present oil system may basically be a gravity feed system for each valve assembly 35.

Other conventional oiling means can be provided for necessary or desired areas, for example, for the lubrication of rotating members 46 and 62 in the pillow blocks 81, and the like.

The above described apparatus illustrates a valving system which is specifically shown for use in conjunction with a four-cylinder, four-cycle engine, but can be easily adapted for use with engines of any number of cylinders and of any desired firing order, or with other types of engines besides the four-cycle, piston and cylinder engine.

The above has been offered for illustrative purposes only, and is not for the purpose of limiting the scope of this invention, which is as defined in the claims below.

That which is claimed is:

1. In a rotary valve system for a motor and the like, including a flow conduit terminating in a combustion chamber, and a rotary valve mounted in a housing, interposed in said flow conduit, the improvement comprising, in combination:

rotatable camshaft means; means for rotating said rotary valve in a manner responsive to rotation of said camshaft means; intermittent occluding and sealing means for preventing flow through said flow conduit comprising a stationary sealing surface intermittently positionable across said conduit, and first means, operated by said camshaft means, for moving said stationary sealing surface into stationary occluding and sealing relation with said flow conduit and out of occluding and sealing relation with said flow conduit, said occluding and sealing means being adapted whereby the intermittent occluding and sealing by said surfaces is correlated with the operation of said rotary valve means, to seal said flow conduit when said rotary valve is in closed position, and to be out of said occluding and sealing relation when said rotary valve is in open position, and second means, operated by said camshaft means, for intermittently exerting pressure through said rotary valve housing to press said stationary sealing surface into improved occluding and sealing relation with said flow conduit when said sealing surface is positioned in said occluding and sealing relation.

2. The motor of claim 1 in which a plurality of said rotary valve systems are connected to and operated by common camshaft means.

3. In a motor, including a fuel flow conduit communicating with a combustion chamber containing a piston for obtaining power by combustion in said chamber, a rotary valve system defining:

a rotary valve, mounted in a housing and interposed in said flow conduit for regulating the flow of combustable materials into said chamber, and also for regulating the flow of exhaust gases out of said chamber; a rotatable camshaft; drive means for rotating said rotary valve in a manner responsive to rotation of said camshaft; rocker arm means positioned about said camshaft, and adapted for reciprocating rocking motion responsive to said rotating camshaft, said rocker arm means defining remote portions spaced from said camshaft, said remote portions carrying valve plate means therebetween; said valve plate means defining an aperture, and being positioned across said flow conduit, whereby, as said rocker arm means and valve plate means rock back and forth upon rotation of said camshaft, said aperture is positioned in registry with said flow conduit in a second rocking position, said camshaft being proportioned to permit said valve plate means in the second rocking position to remain stationary in said sealing position for a predetermined period of the rotational cycle of said camshaft; and additional camming means on said camshaft for pressing said housing against said valve plate, while said valve plate occupies said second position, to facilitate said stationary sealing, said camming means being adapted for pressure-releasing disengagement from said housing during said rocking motion of the valve plate between said first and second rocking positions, said drive means for rotating the rotary valve in a manner responsive to rotation of said camshaft being adapted to cause said rotary valve to be in open position when said valve plate means is in its first, flow-permitting position.

4. The motor of claim 3 in which said valve plate means is positioned adjacent a valve plate bed, and presses against said valve plate bed during said stationary sealing, said flow conduit extending through an aperture in said valve plate bed.

5. The motor of claim 4 defining means for resiliently biasing said rotary valve block away from said valve plate, to facilitate said rocking motion.

6. The motor of claim 5 in which said cam means moves said rotary valve block into engagement with said valve plate to facilitate sealing a total distance of 0.01 to 0.003 inch.

7. The motor of claim 6 in which annular sealing means are positioned about said aperture in the valve bed, to further facilitate sealing.

8. The motor of claim 7 in which the surface of said rotary valve block facing said camshaft is defined by a separate plate member, and further including spacing adjustment means, to permit variable adjustment of the spacing of said plate member with respect to the remainder of said rotary valve block.

9. In a motor and the like, a plurality of rotary valve systems as defined in claim 8, positioned in linear array, and connected together and operated by a common camshaft.

10. The motor of claim 9 in which a plurality of said rotary valve systems include rotary valves which are all defined by a single rotatable rod member defining inlet and exhaust valve ports therethrough.

11. The motor of claim 10 in which the maximum compression ratio created in the combustion chambers by said piston is in excess of ten to one.

12. The motor of claim 10 in which said valve plate means is rigidly carried at one end thereof by said rocker arm means, and is slidingly retained at its other end by said rocker arm means, whereby said valve plate means can be flexibly deflected into stationary sealing relation by said rotary valve block, impelled by said additional camming means.

13. The motor of claim 12 in which resiliently biased bearing means are provided adjacent the slidingly retained end of the valve plate means for support thereof, and to resiliently bias said valve plate means away from said valve plate bed.

14. The motor of claim 13 in which said aperture of the valve plate means occupies an off-center position on said valve plate means.

15. The motor of claim 13 in which said rocker arm means are connected to a pivot shaft, positioned above said camshaft in position of normal operation, said pivot shaft defining a tubular oil flow conduit, and further defining apertures for depositing oil by gravity feed upon said camshaft adjacent said rotary valve housing, whereby oil falling by gravity lubricates the surfaces of said camshaft which engage said rotary valve housing and the rocker arms, and oil falling further lubricates said valve plate, and further including aperture means positioned at the top of said rotary valve block for permitting small amounts of oil to pass through said block to lubricate said rotary valve; and collection means positioned below said valve plate for recycling said oil.

16. The motor of claim 15 in which said combustion chamber comprises a relatively narrow diameter tubular portion adjacent said valve plate, and a relatively enlarged diameter tubular portion which carries said piston, spaced from said valve plate.

17. The motor of claim 16 which carries a spark plug laterally positioned in said relatively narrow tubular portion of the combustion chamber.

18. In a motor, including a fuel flow conduit communicating with the combustion chamber containing a piston for obtaining power by combustion in said chamber, a rotary valve system defining:

a rotary valve, mounted in a housing and interposed in said flow conduit for regulating the flow of combustable materials into said chamber, and also for regulating the flow of exhaust gases out of said chamber; a rotatable camshaft; drive means for rotating said rotary valve in a manner responsive to rotation of said camshaft; rocker arm means positioned about said camshaft; and adapted for reciprocating rocking motion responsive to said rotating camshaft, said rocker arm means defining remote portions spaced from said camshaft, said remote portions carrying a valve plate means therebetween; said valve plate means defining an aperture, and being positioned across said flow conduit, whereby, as said rocker arm means and valve plate means rock back and forth upon rotation of said camshaft, said aperture is positioned in registry with said flow conduit in a first rocking position, and an unbroken sealing surface of said valve plate means obstructs and seals said flow conduit in a second rocking position, said camshaft being proportioned to permit said valve plate means in the second rocking position to remain stationary in said sealing position for a predetermined period of the rotational cycle of said camshaft; and sealing means positioned about said flow conduit for engagement with said unbroken sealing surface of the valve plate in said second rocking position to facilitate sealing.

19. The motor of claim 18 in which said sealing means comprises an annular groove positioned about said flow conduit, a ring member positioned within said groove and defining a split space therethrough, to facilitate flexing of said ring member, an insert member positioned within said groove across said split space, to facilitate the sealing thereof, and resilient biasing means for urging said ring member and insert member upwardly to project slightly above said groove, and to be resiliently depressable into said groove by said valve plate means in the sealing position.

20. The motor of claim 18 in which the surface of said rotary valve block facing said camshaft is defined by a separate frame member, and further including spacing adjustment means, to permit variable adjustment of the spacing of said frame member with respect to the remainder of said rotary valve block.

21. In a motor and the like, a plurality of rotary valve systems as defined in claim 20, positioned in linear array and connected together and operated by a common camshaft.

22. The motor of claim 21 in which a plurality of said rotary valve systems include rotary valves which are all defined by a single rotatable rod member defining transverse inlet and outlet valve apertures therethrough.

23. The motor of claim 22 in which said single rotatable rod member passes through an aperture in said rotary valve block, said aperture of the rotary valve block being slightly oval in shape, and additional camming means on said camshaft for pressing said block against said valve plate while said valve plate occupies said second position, to facilitate said stationary sealing, said camming means being adapted for pressure-releasing disengagement from said block during said rocking motion of the valve plate between said first and second rocking positions; said valve block being transversely movable with respect to said single rotatable rod member; said drive means for rotating the rotary valve member in a manner responsive to rotation of said camshaft being adapted to cause said rotary valve member to be in closed, flow-occluding position when said valve plate is in its second sealing position, and to cause said rotary valve member to be in open position when said valve plate is at its first, flow permitting position, to facilitate sealing of said combustion chamber during the ignition stage of the motor operation cycle.

24. The motor of claim 23 in which said cam means moves said rotary valve block into engagement with said valve plate to facilitate sealing a total distance of 0.01 to 0.03 inch.

25. The motor of claim 24 defining means for resiliently biasing said rotary valve block away from said valve plate, to facilitate said rocking motion.

26. The motor of claim 3 in which said valve plate means is rigidly carried at one end thereof by said rocker arm means, and is slightly retained at its other end by said rocker arm means, whereby said valve plate means can be flexibly deflected into stationary sealing relation by said rotary valve block, impelled by said additional camming means.

27. The motor of claim 26 in which resiliently biased bearing means are provided adjacent the slidingly retained end of the valve plate means for support thereof, and to resiliently bias said valve plate means away from said valve plate bed.

28. The motor of claim 27 in which said aperture of the valve plate means occupies an off-center position on said valve plate means.

29. The motor of claim 2 in which each of said plurality of rotary valve systems comprises a rotary valve positioned in a valve housing block capable of independent movement from the other valve housing blocks of the motor, each valve housing block being positioned adjacent the opposite side of said sealing surface from the seal formed against said flow conduit, each valve housing block defining aperture means to permit fluid flow therethrough as part of its associated flow conduit when the stationary sealing surface is out of said occluding and sealing relation, said second means, operated by said camshaft means, being adapted to press said valve housing blocks in an individual and separate manner against the stationary sealing surfaces, when in said occluding and sealing relation, to provide improved sealing of the combustion chambers.

30. The motor of claim 29 in which said intermittent occluding and sealing means is defined by valve plate means positioned on a valve plate bed, said valve plate means being adapted to be pressed against said valve plate bed by said valve housing block during said stationary sealing, said flow conduit extending through an aperture in said valve plate bed.

31. In a motor and the like, a plurality of rotary valve systems as defined in claim 30, the rotary valves of said systems being all defined by a single, rotatable rod member.

32. The motor of claim 31 in which said flow conduit communicates with a combustion chamber containing a piston for obtaining power by combustion in said chamber, said combustion chamber comprising a relatively narrow-diameter tubular portion adjacent the inlet of said flow conduit, and a relatively enlarged-diameter tubular portion which carries said piston, spaced from said inlet.

33. The motor of claim 32 in which the maximum compression ratio created in said combustion chamber by said piston is in excess of ten to one.

34. The motor of claim 30 defining means for resiliently biasing each valve housing block away from said valve plate, to facilitate motion of said valve plate into and out of stationary sealing relation.

35. The motor of claim 34 in which said second means, operated by the camshaft means, moves said valve housing block into pressing relation with said valve plate, to improve said occluding and sealing, by a total distance of 0.01 to 0.03 inch.

36. The motor of claim 35 in which annular sealing means are positioned about said aperture in the valve plate bed, to further facilitate sealing.

37. The motor of claim 36 in which said annular sealing means comprises an annular groove positioned about said flow conduit, a ring member positioned within said groove and defining a split space therethrough, to facilitate flexing of said ring member, an insert member positioned within said groove across said split space, to facilitate the sealing thereof, and resilient biasing means for urging said ring member and insert member upwardly to project slightly above said groove, and to be resiliently depressible into said groove by said valve plate means in the sealing position.

38. The motor of claim 36 in which a single rotatable rod member defining the rotary valves passes through an opening in each rotary valve block, the openings of the rotary valve blocks being slightly oval in shape, whereby said valve block is transversely moveable with respect to said single, rotatable rod member to permit the pressing of said valve housing blocks against said stationary sealing surface.

* * * * *